US005617650A

United States Patent [19]

Grim

[11] Patent Number: 5,617,650

[45] **Date of Patent: *Apr. 8, 1997**

[54] VACUUM FORMED CONFORMABLE SHOE

[76] Inventor: Tracy E. Grim, 3010 W. Boston Ct., Broken Arrow, Okla. 74012

[ * ] Notice: The portion of the term of this patent subsequent to Jan. 24, 2012, has been disclaimed.

[21] Appl. No.: 406,004

[22] Filed: Feb. 27, 1995

Related U.S. Application Data

[63] Continuation-in-part of Ser. No. 11,345, Jan. 29, 1993, Pat. No. 5,392,534, which is a continuation-in-part of Ser. No. 965,176, Oct. 23, 1992, Pat. No. 5,383,290.

[51] Int. Cl.[6] ..... A43B 7/14

[52] U.S. Cl. ..... 36/88; 36/93; 36/154

[58] Field of Search ..... 36/88, 93, 146, 36/154, 3 R, 3 A, 3 B, 8.4, 44, 71, 25 R, 147, 89, 91, 92, 114, 28, 29, 30 R, 35 R, 35 B, 43, 11.5

[56] References Cited

U.S. PATENT DOCUMENTS

| | | | |
|---|---|---|---|
| 3,212,497 | 10/1965 | Dickinson . | |
| 3,968,577 | 7/1976 | Jackson | 36/11.5 |
| 4,702,022 | 10/1987 | Porcher | 36/71 |
| 4,724,627 | 2/1988 | Sisco | 36/71 |
| 4,848,364 | 7/1989 | Bosman . | |
| 4,860,463 | 8/1989 | Pin | 36/29 |
| 4,905,320 | 3/1990 | Squyers, Jr. . | |
| 4,914,837 | 4/1990 | Rieffel | 36/11.5 |
| 4,999,932 | 3/1991 | Grim | 36/114 |
| 5,088,478 | 2/1992 | Grim . | |
| 5,144,708 | 9/1992 | Pekar . | |
| 5,154,185 | 10/1992 | Latimer et al. . | |
| 5,203,793 | 4/1993 | Lyden | 36/93 |
| 5,383,290 | 1/1995 | Grim | 36/93 |
| 5,392,534 | 2/1995 | Grim | 36/88 |

*Primary Examiner*—M. D. Patterson
*Attorney, Agent, or Firm*—Oppenheimer Poms Smith

[57] ABSTRACT

Shoes are provided with soles and/or upper portions which conform to the configuration of the user's feet by the use of vacuum formable bladders in the sole of the shoes and/or in the sides of the upper portions of the shoes. The bladders are filled with material, such as small resilient or interlocking particles, which retains a configuration conforming to the shape of the feet under reduced pressure conditions. A vacuum pump is provided, and it may be located in the heel area of the shoe to be actuated by walking or running to evacuate air from the bladders. The shoe may be removed, and the vacuum formable bladders will retain their shape as long as the vacuum is maintained.

36 Claims, 12 Drawing Sheets

FIG. 1
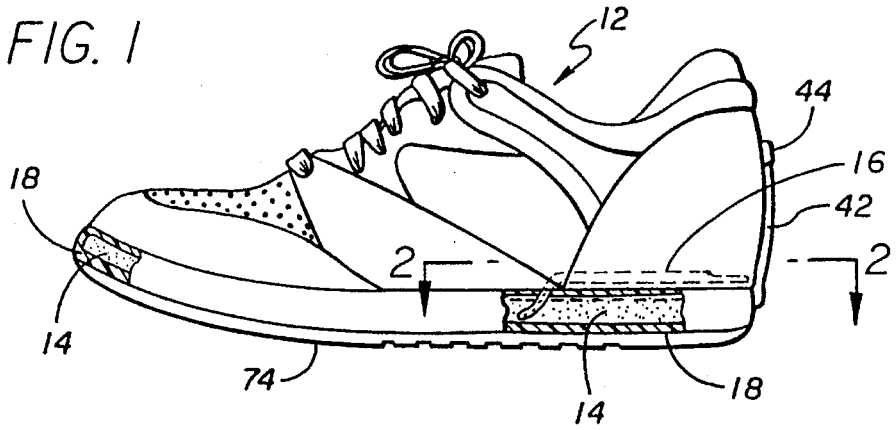
FIG. 2
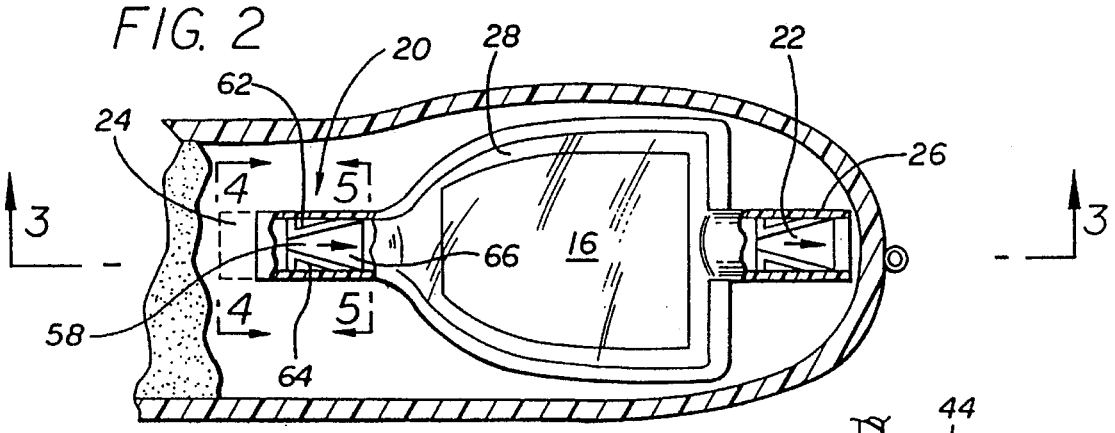
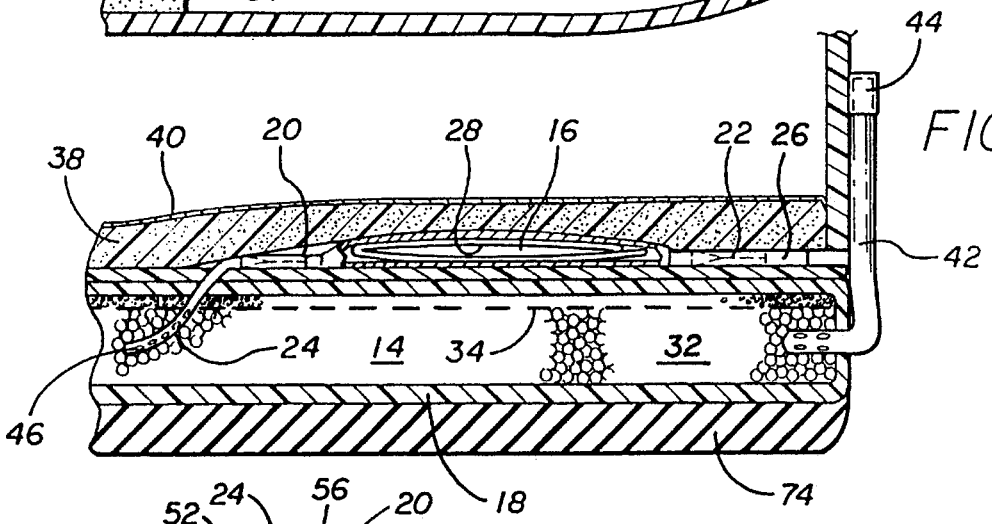
FIG. 3
FIG. 4
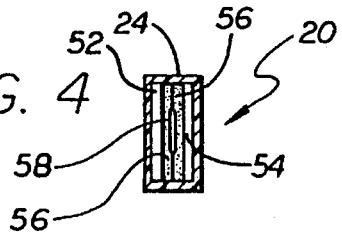
FIG. 5
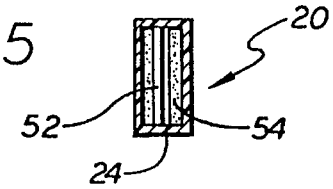
FIG. 6
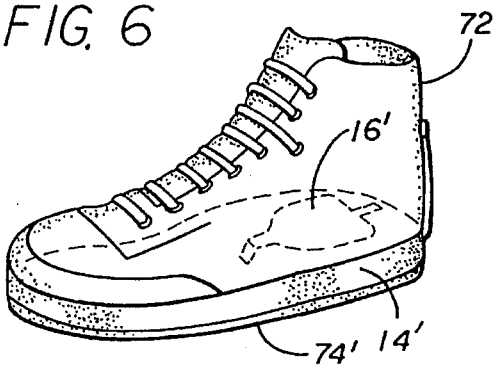

122
126
124
128
130
132
136
138
140
142
144
146
148
150
152
154

FIG. 16
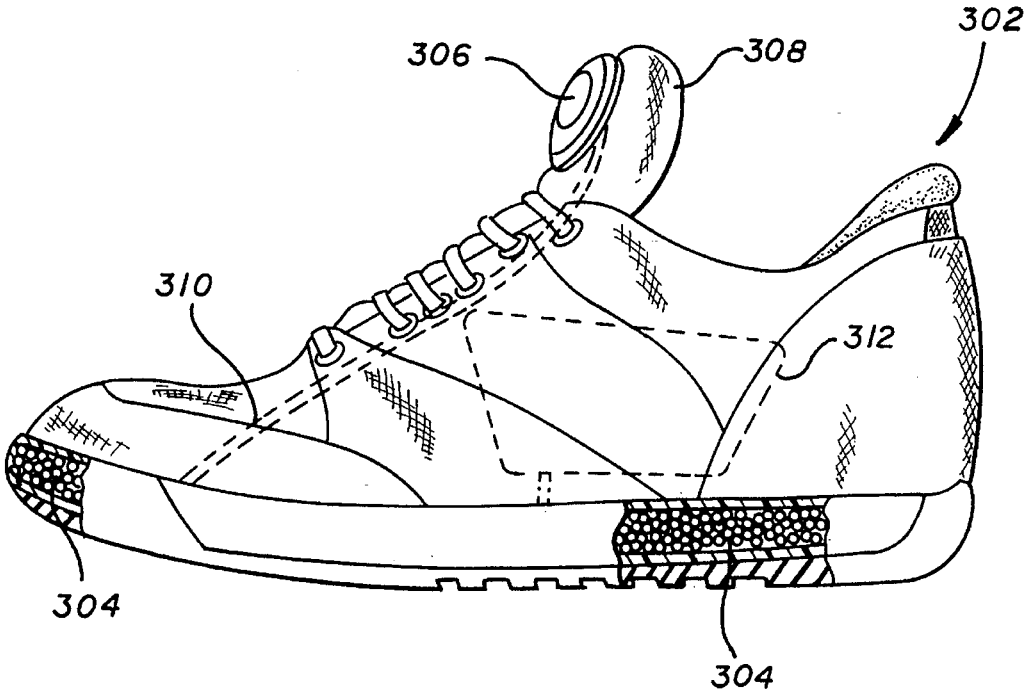
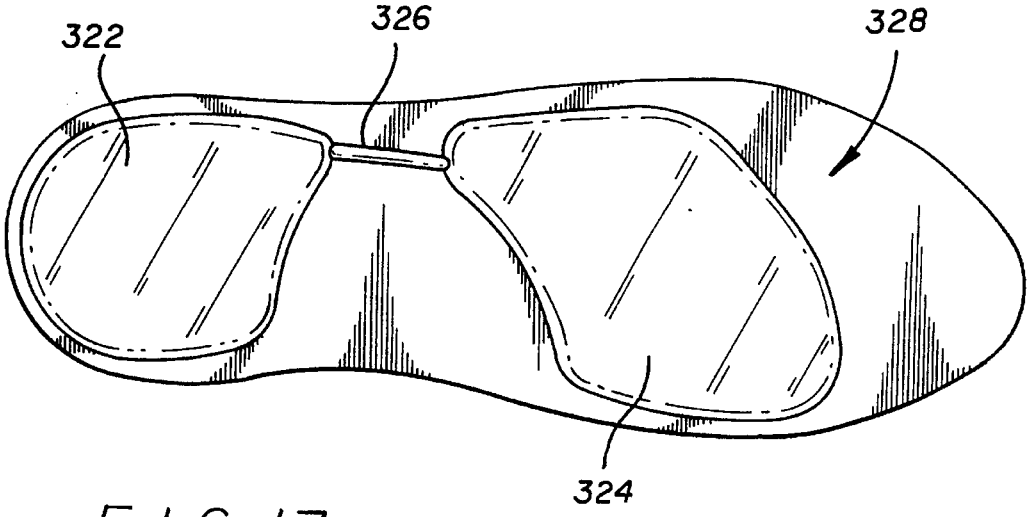
FIG. 17

FIG. 19
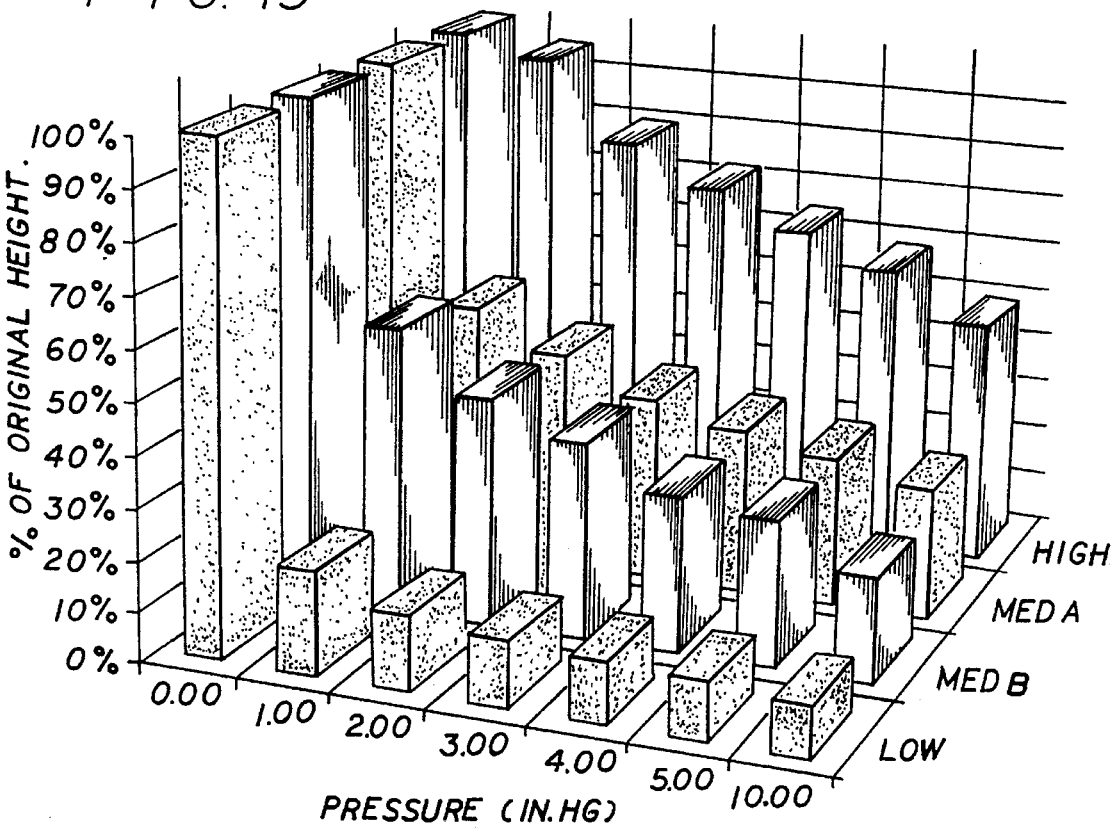
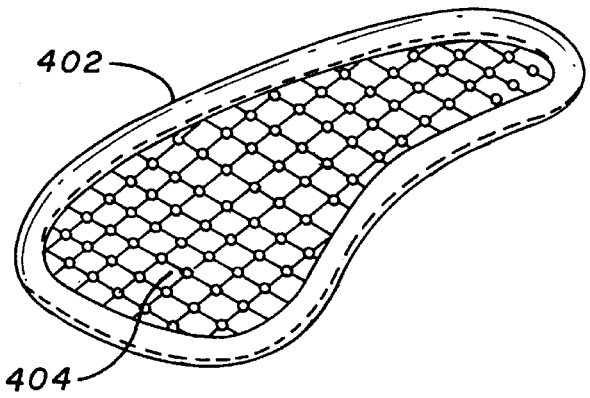
FIG. 20
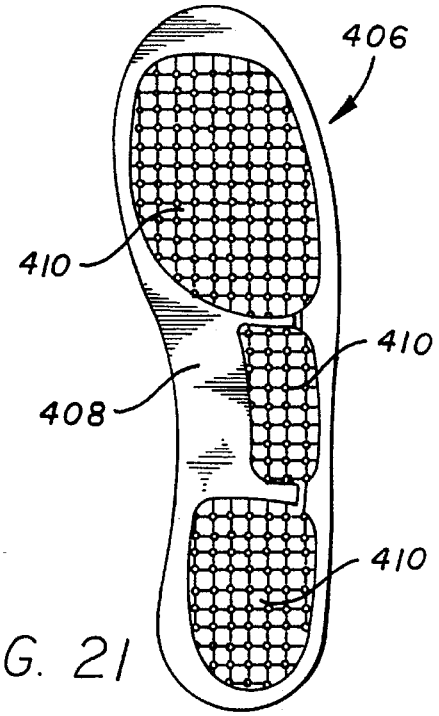
FIG. 21

VACUUM FORMED CONFORMABLE SHOE

RELATED PATENT APPLICATIONS

This application is a continuation-in-part of U.S. patent application Ser. No. 08/011,345, filed Jan. 29, 1993, now U.S. Pat. No. 5,392,534 which is a continuation-in-part of U.S. patent application Ser. No. 07/965,176, filed Oct. 23, 1992, now U. S. Pat. No. 5,383,290.

FIELD OF THE INVENTION

This invention relates to shoes which conform to the configuration of the user's foot.

BACKGROUND OF THE INVENTION

It has previously been proposed to provide resilient soles for footwear, and H. J. Bronson U.S. Pat. No. 2,598,217 shows one example of such footwear. It has also been proposed to have inflatable bladders in footwear and to have manual or foot actuated pumps for circulating air in footwear or for inflating the bladders mentioned above.

SUMMARY OF THE INVENTION

It would be desirable to have a shoe sole which conformed to the shape of the bottom of a persons foot, instead of the substantially flat soles which are normally present in shoes. In a similar manner, it would also be useful to have the upper portion of the shoe conform to the exact configuration of the user's feet.

Accordingly, a principal object of the present invention is to provide a shoe or shoe insert having a sole which conforms to the configuration of the bottom of the foot of the user; and another object of the invention is to provide conforming upper portions of footwear.

In one illustrative embodiment of the invention, this object is realized by a shoe having an inner sole formed of a sealed bladder containing resilient or semi-resilient material, which may be particulate, or interlocking particulate materials and which holds its deformed configuration when the bladder is evacuated, or when air is partially or entirely withdrawn from the bladder. The sole of the shoe may include a vacuum pump for actuation as the user walks or runs, and this pump is coupled to the inner sole bladder by a one-way valve which permits the flow of air toward the pump and out of the bladder. A second one-way valve is coupled from the pump to the atmosphere, so that as the pump is compressed air is forced out into the atmosphere. Then, as the pump expands, air from the inner sole bladder is drawn into the pump, creating a partial vacuum in the bladder, so that the material in the inner sole bladder retains its configuration, conforming to the bottom of the sole of the foot of the user.

An additional manually actuated valve may be provided to permit flow of air into the inner sole bladder, so that it may be configured, or reconfigured, starting with atmospheric pressure therein.

The one-way valves associated with the pump in the sole of the shoe may be "flapper" or "duck-bill" type valves formed of sheet plastic so that they may be substantially flat and readily accommodated within the shoe sole geometry.

In addition to or instead of the vacuum formed sole bladder, the upper portions of the shoe may be provided with bladders coupled to or separate from the sole bladder and similarly conformed to the shape of the user's foot.

Instead of a bladder or bladders and pump which are integral with the shoe, the invention may be implemented by an insertable assembly including the bladder(s), pump and valves.

In preferred embodiments included in the present continuation-in-part, the pump is located under the conformable sole, to permit conformation of the sole to the foot with no interference from the pump.

In accordance with another aspect of the invention, the particulate material may have substantially interlocking shapes when subject to vacuum conditions in a bladder. Such interlocking particulate material may be implemented by non-spherical particles of virtually any type of material, by resilient material, for example, by very small pieces of foam polyethylene.

Other material which may be employed includes yieldable material which retains its shape under partial vacuum conditions such as open cell foam of a medium firmness or durometer level.

It is further noted that a single cycle pump may be implemented by the use of a bladder forming a portion such as the sole of a shoe containing yieldable material which retains its shape under partial vacuum conditions, utilizing a one-way valve permitting one to exhaust air from the bladder, when the bladder is compressed. For many purposes, this provides substantial advantages and avoids the need for a full, multiple cycle pump configuration with a separate pump unit and one way valves at both the input and output of the pump. When it is desired to permit air to return into the bladder, the valve arrangements may be actuated so that air freely flows into the bladder.

Other aspects and features of various embodiments of the invention include the following:

1. The use of interconnected particulate material interconnected by filaments bonded to the particles, for example, to reduce particle migration.
2. The use of a combination of particulate material and open cell foam, in various footwear configurations, having reduced pressure conformation.
3. The use of mesh or woven fabric pockets to preclude migration of particulate material.
4. The formation of bladders for reduced pressure conformation, using reaction injection molding, involving the in-situ formation of a sole member having a core of open cell foam and a concurrently formed peripheral outer "skin" formed of the same flexible plastic material, encapsulating the foam to form an air-tight bladder.
5. The formation of sandals involving a sole member formed of a reduced pressure conformable bladder and straps for securing the sole member to the foot.
6. A reduced pressure conformable sock construction, for use within an over-size shoe.
7. The use of open cell foam having a stiffness or durometer scale hardness or resiliency, approximately matched to the weight of the user, to achieve both vacuum conformation and also resilient shock absorbing, with the foam material within a bladder so that pressure and partial evacuation reduces the thickness of the foam.
8. The use of particulate material of interlocking shapes, configurations, or properties to reduce or avoid particle migration. Resilient particles or particles of irregular shapes have this interlocking property,under partial vacuum conditions.

Other objects, features and advantages of the invention will become apparent from a consideration of the following detailed description and from the accompanying drawings.

BRIEF DESCRIPTION OF THE DRAWINGS

FIG. 1 shows a low quarter shoe provided with a conformable shoe sole, illustrating the principles of the present invention;

FIG. 2 is a partial, cross-sectional view taken along lines 2—2 of FIG. 1;

FIG. 3 is a cross-sectional view taken along lines 3—3 of FIG. 2;

FIG. 4 is an end view of one specific valve structure which may be employed in implementing the one-way valve in accordance with the present invention and taken along lines 4—4 of FIG. 2;

FIG. 5 is a view of the valve shown in FIGS. 2 and 4, taken from the other end, along lines 5—5 of FIG. 2;

FIG. 6 illustrates the principles of the invention as implemented in a shoe which extends up over the ankle;

FIG. 16 shows an athletic shoe with a pump in the tongue of the shoe, and a vacuum formable bladder in the sole thereof;

FIG. 17 indicates diagrammatically the location of vacuum formable bladders in the sole of the shoe under high stress areas;

FIG. 19 is a graphical showing of foam compression vs. partial vacuum pressure for open cell foams of varying stiffness;

FIGS. 20 and 21 are schematic showings of particulate material mounted on flexible interconnecting filaments to avoid particle migration in a shoe sole or bladder environment;

DETAILED DESCRIPTION OF THE PREFERRED EMBODIMENTS

Figure 7:
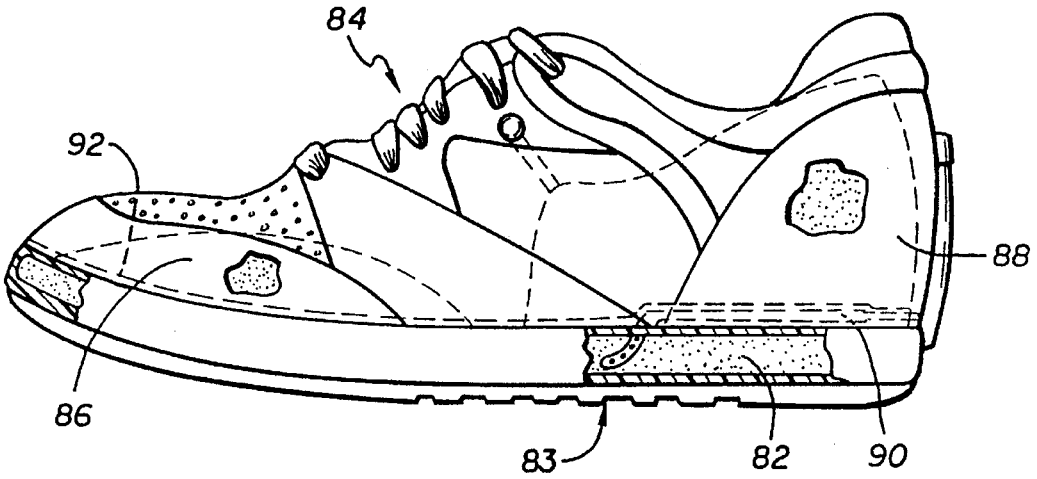
FIG. 7 shows an implementation of the invention in which a shoe is provided with conformable vacuum formed bladders on the upper portions thereof, in addition to the sole.

Referring more particularly to the drawings, FIG. 1 shows a low quarter shoe 12 having an inner sole 14 which is conformable to the shape of the bottom of the user's foot. FIGS. 1, 2 and 3 also show a vacuum pump 16 which serves to form a partial vacuum within the air tight bladder 18 which is an important part of the conformable sole 14.

On either side of the pump 16 are one-way valves 20 and 22 which serve to draw air from the bladder 18 through the channel 24 and to expel air to the right and outside the shoe through the outlet channel 26 as shown in FIG. 3.

Now, from an overall mode of operation standpoint, when a user steps down onto the shoe, the air within the pump 16 will be expelled out through the one-way valve 22 through the exhaust channel 26. However, when the user raises his foot so that pressure is released from the pump 16, the inner metallic spring 28 will force the pump to its expanded state, as shown in FIG. 3, and air will be drawn in through the one-way valve 20 and channel 24, to produce reduced pressure or partial vacuum condition within the bladder 18 forming the outer wall of the inner sole 14.

The particulate material within the bladder 18 may, for example, be small polyethylene balls or spheres, which are in the order of 1/16 of an inch in diameter, or particles of an irregular configuration. It has been determined that, under reduced pressure conditions, the bladder 18 will compress or collapse, and the particles or spheres 32 will engage one another, and will interlock and retain the form into which they have been pressed by the bottom of the user's foot. Various materials may be used for the particulate material 32 and they may be, for example, polystyrene, or styrofoam, which is expanded polystyrene. Further, instead of a single, homogeneous body of particulate material, the bladder 18 may be divided into two chambers by an apertured thin plastic sheet indicated by the dashed line 34, with a smaller diameter or smaller particles being located above the apertured partition 34 as compared with the slightly larger dimension particles below the apertured flexible partitioning layer of sheet material 34. With the smaller spherical particles above the separating sheet 34, the inner sole will be more comfortable for the user, and the overlying layer 38, which may include foam material, may be thinner or may be dispensed with altogether. The top surface 40 facing the foot of the user may have a thin layer of leather or other synthetic material of the type normally employed to line shoes, to avoid direct contact of the foot or sock with the cushioning layer 38 of foam or other similarly resilient material.

It is desired that the bladder 18 be initially at atmospheric pressure, and the vent tube 42 with its associated valve 44 permits the inflow of air into the bladder 18 forming the casing around the inner sole 14, so that the bladder is in its unevacuated and uncompressed state. When the shoe is initially tried on, it is desired that the valve 44 be open, so that the foot will press the resilient particulate material and shift it so that it conforms to the shape of the bottom of the foot. The valve 44 is closed (either at this stage or before putting the shoe on), and the wearer walks or runs to the actuate the vacuum pump 16, and the spherical particles engage one another and retain a "set" conforming to the bottom of the foot. In practice, it has been found that small polyethylene particles in the order of 1/32 or 1/16 of an inch in diameter hold their configuration to a surprising extent when the bladder containing them is partially evacuated.

The end 46 of the plastic conduit 24 may extend for a substantial length into the inner sole 14, and is provided with a series of very fine openings, of smaller diameter than the diameter of the spherical particles, so that as air is drawn out of the bladder 18, the openings to the conduit 24 are not blocked.

Attention will now be directed to the mode of operation of the valves 20 and 22 through a consideration of the diagrammatic showings of FIGS. 4 and 5. Incidentally, in passing, reference is made to U.S. Pat. No. 5,026,339, granted Jun. 25, 1991, which discloses a somewhat similar sheet plastic valve. It is also noted that the flat plastic conduit 24 is shown as being of rectangular configuration of FIGS. 4 and 5, but it would actually be somewhat oval and somewhat flatter than is shown in FIGS. 4 and 5. The actual working parts of the valve are two, small, elongated, substantially rectangular sheet plastic members 52 and 54. Incidentally, they are shown in FIG. 4 as being significantly greater thickness than they would actually be relative to the size of the conduit. FIG. 4 is a view of the valve 20 from the inlet side, or from the left-hand side looking at the valve 20 as shown in FIG. 2. The two rectangular sheet valve members 52 and 54 are secured to the broader side walls of the conduit 24 and then are gradually brought together and bonded to one another as well as to the side walls at the areas 56, leaving a central opening 58. A small diameter tube may be mounted at the central opening point 58 to ensure that it remains open, if desired. Returning to FIG. 2, the two sheet plastic valve members 52 and 54 are bonded together along the lines 62 and 64 as shown in FIG. 2, permitting the air to flow through the opening 58 and between the adjacent flaps of the valve members 52, 54 in the area indicated in the arrow 66 in FIG. 2.

FIG. 5 is a diagrammatic showing of the valve 20 from the right hand or outlet side, with reference to FIG. 2. FIG. 5 shows the two end rectangular plastic members 52 and 54 which form the outlet flap in the closed position, preventing the flow of air from right to left in FIG. 2, when the vacuum pump 16 is not exhausting air. However, when the spring members 28 are expanding so that air is drawn into the pump 16, the output flaps of the plastic members 52, 54, as shown in FIG. 5, will open at the central area thereof so that air will flow through from left to right in the valve structure.

The valve 22, shown to the right of the pump 16 in FIG. 2, may have substantially the same internal configuration as the valve 20, as described above. Alternatively, both of the one-way valves may be constructed using small conventional one-way valves of the spring biased ball and socket variety, and more than one of these valves may be used in parallel in order to make the assembly smaller and flatter, if this alternative is adopted.

FIG. 6 shows a high-top shoe 72 which is provided with a vacuum pump 16' and an inner sole 14' which is constructed substantially as described hereinabove for the embodiment of FIGS. 1–5. Incidentally, the relative thickness of the lowermost outer sole 74 (FIGS. 1–3) or 74' (FIG. 6) and the inner soles 14 or 14' may be varied to suit the need of the particular activities for which the shoes are to be employed.

Further, the function of the vacuum release valve 44 may be accomplished by the use of a simple flexible inlet tube 42 having thin walls, so that it may be folded and tucked under a flap to block the flow of air, and unfolded and opened to permit the inflow of air.

Figure 8:
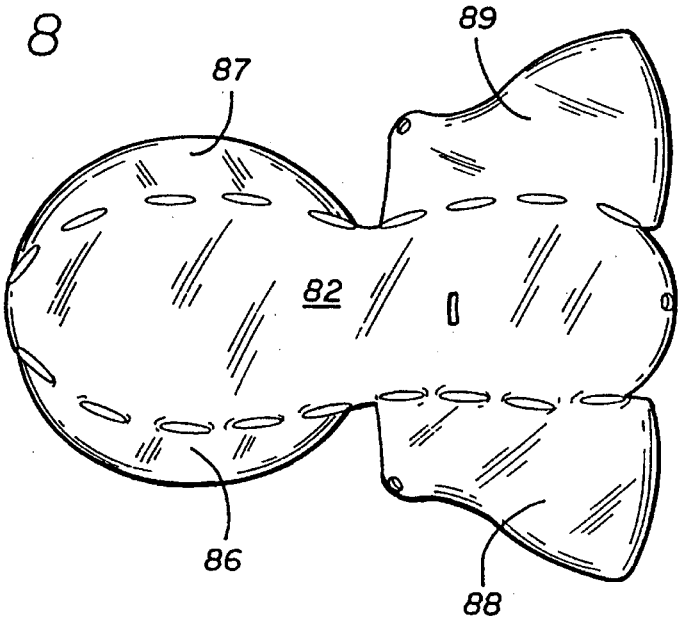
FIG. 8 shows the intercoupled sole and side bladders of FIG. 7 removed from the shoe and folded out flat.

FIG. 7 shows the principles of the invention applied to the upper portions of a shoe, as well as to the bladder 82 within the sole 83 of the shoe. More specifically, note that the low quarter shoe 84 includes the bladder zones 86 and 88 at one side of the front portion of shoe 84, and in the rear or heel and ankle area, respectively. FIG. 8 shows the intercoupled bladders 82, 86 and 88 in the unfolded configuration and removed from the shoe, along with bladder zones 87 and 89 which are also coupled to the sole bladder 82, but which are on the right side of the shoe.

Returning to FIG. 7, the pump 90 is somewhat recessed into the sole and the bladder 82 and pump 90 are covered by a layer 92 of resilient material, corresponding to layer 38 in FIG. 3.

Figure 9:
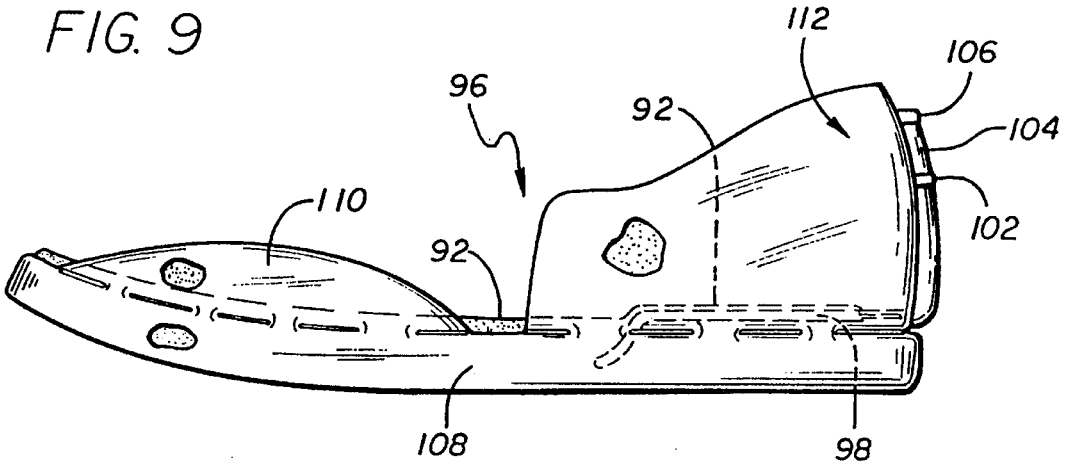
FIG. 9 shows a self pumping vacuum formable insert for a shoe.

FIG. 9 shows a vacuum formable insert 96 which may be used with oversized shoes. It includes a pump 98 which exhausts air through conduit 102, which is recessed into the back of the insert. A second conduit 104 is coupled to the top of insert 96 and includes a valve 106 for permitting the inflow of air into the insert 96.

The entire insert 96 is essentially one big self sustaining bladder with intercoupled sole 108, and upper front and rear sections 110 and 112, respectively. The inner construction of the pump and sole is substantially as shown in FIG. 3.

Figures 10, 11:
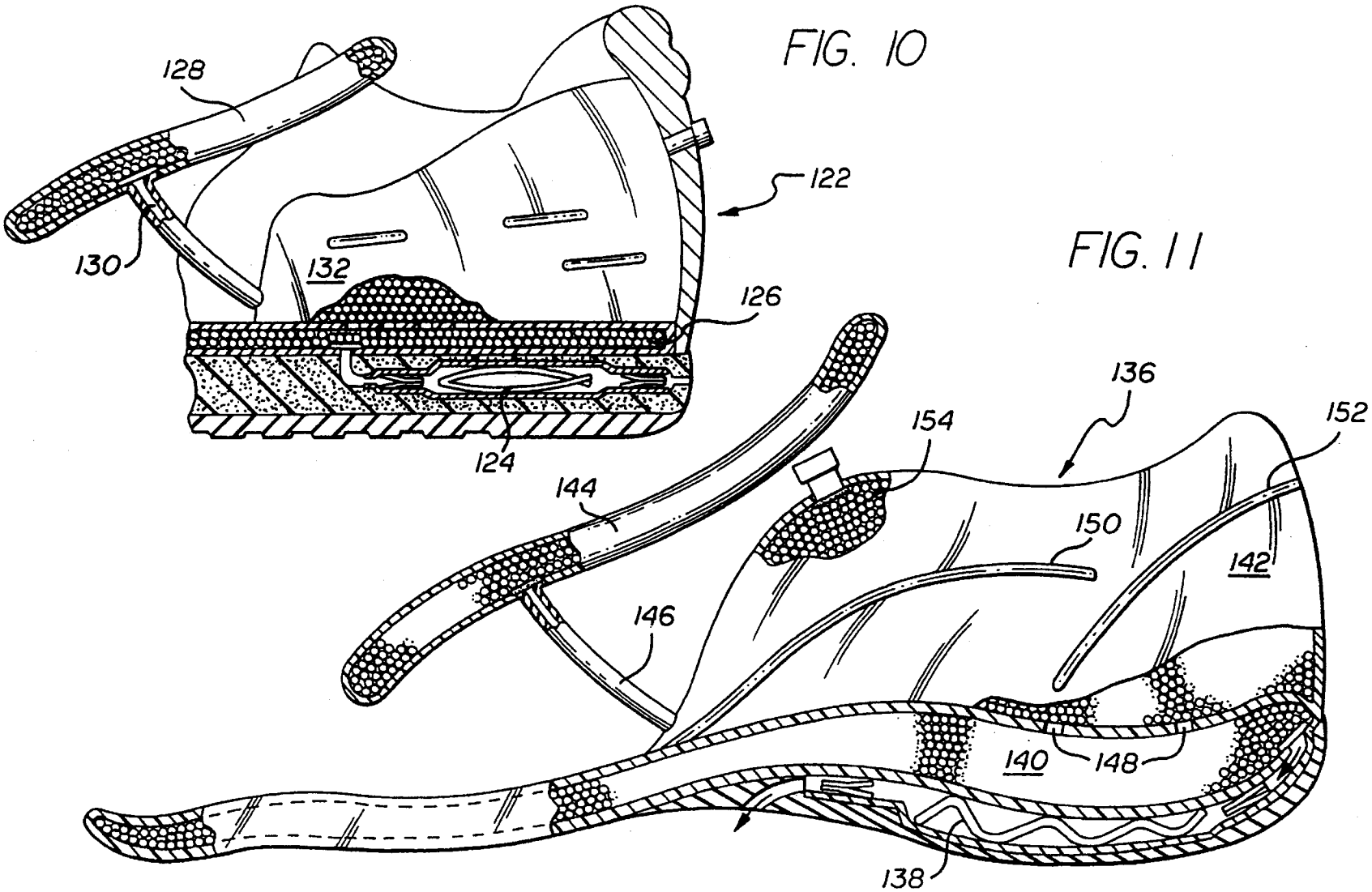
FIG. 10 shows an alternative shoe configuration similar to the showings of FIGS. 1–7.
FIG. 11 is a cross-sectional view of an alternative shoe insert, illustrating the principles of the invention.

Referring to FIG. 10 of the drawing, it is a partial cross-sectional view of a shoe which is similar to that of FIGS. 1–5 of the drawings with a few exceptions. More particularly, the pump 124 is located below the conformable sole 126, and the shoe is provided with a conformable tongue 128 which is also a bladder filled with particulate material. It is further noted that the vacuum tube 130 is coupled from the conformable tongue 128 to the bladder portion 132 which extends around the rear of the foot. Apart from the foregoing differences, the construction and the mode of operation of the conformable shoe of FIG. 10 is substantially similar to that described hereinabove in connection with FIGS. 1–5 of the drawings.

FIG. 11 shows a shoe insert 136 which is intended for mounting within an athletic or other type of shoe. The insert 136 includes the pump 138, a conformable sole 140, vacuum formed upper bladders 142, and an intercoupled tongue 144, with the vacuum tube 146 linking the tongue 144 to the remainder of the evacuated system. The evacuated chambers 142 are, of course, coupled to the sole bladder 140 around the outer rear periphery of the heel of the insert 136, for example, at openings 148. In order to hold the particulate material against migration down toward the lower edges of the rear and side lining member 142, the bladder forming the side lining may be provided with heat sealed separating lines 150 and 152, which involve a bonding of the inner plastic wall with the outer plastic wall of bladder 142 along the indicated lines 150 and 152. This will permit the evacuation of the entire bladder 142, as well as the tongue 144, but will restrain the particulate material, for example, in area 154, from settling to the lower edge of the bladder 142.

Figure 12:
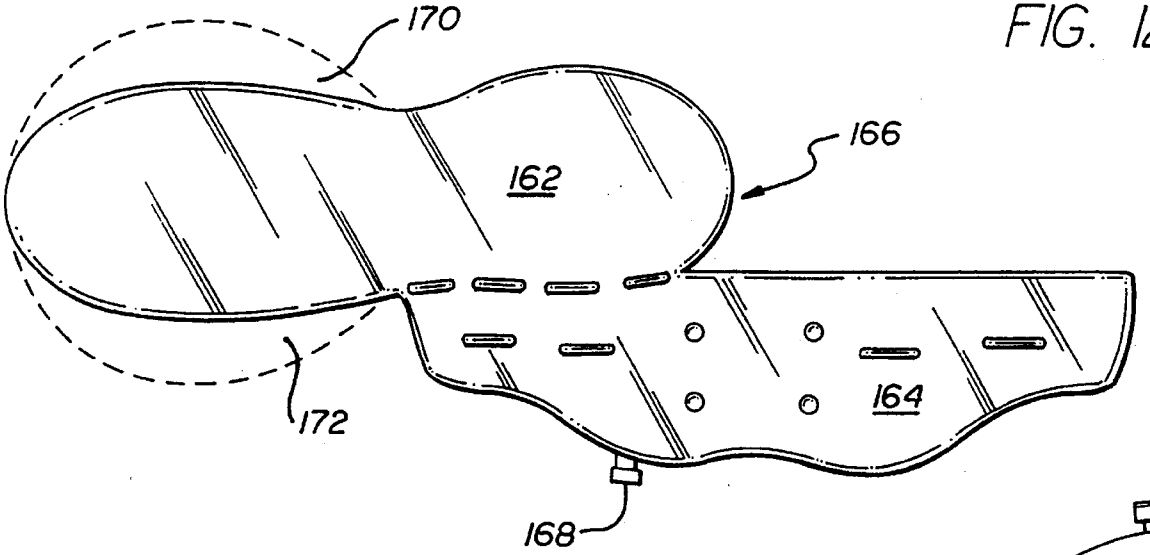
FIG. 12 is a top plan view of an insert for implementing the invention.

FIG. 12 is a top plan view of an insert such as that shown in FIG. 11, with the sole portion 162 coupled to the inner lining portion 164 which extends around the heel and ankle area of the foot to the rear thereof, when the overall insert 166 is assembled with a shoe. The relief valve 168 is shown coupled to the bladder portion 164. The dashed line areas 170 and 172 indicate schematically additional bladders which may extend up over the front portion of the foot.

Figure 13:
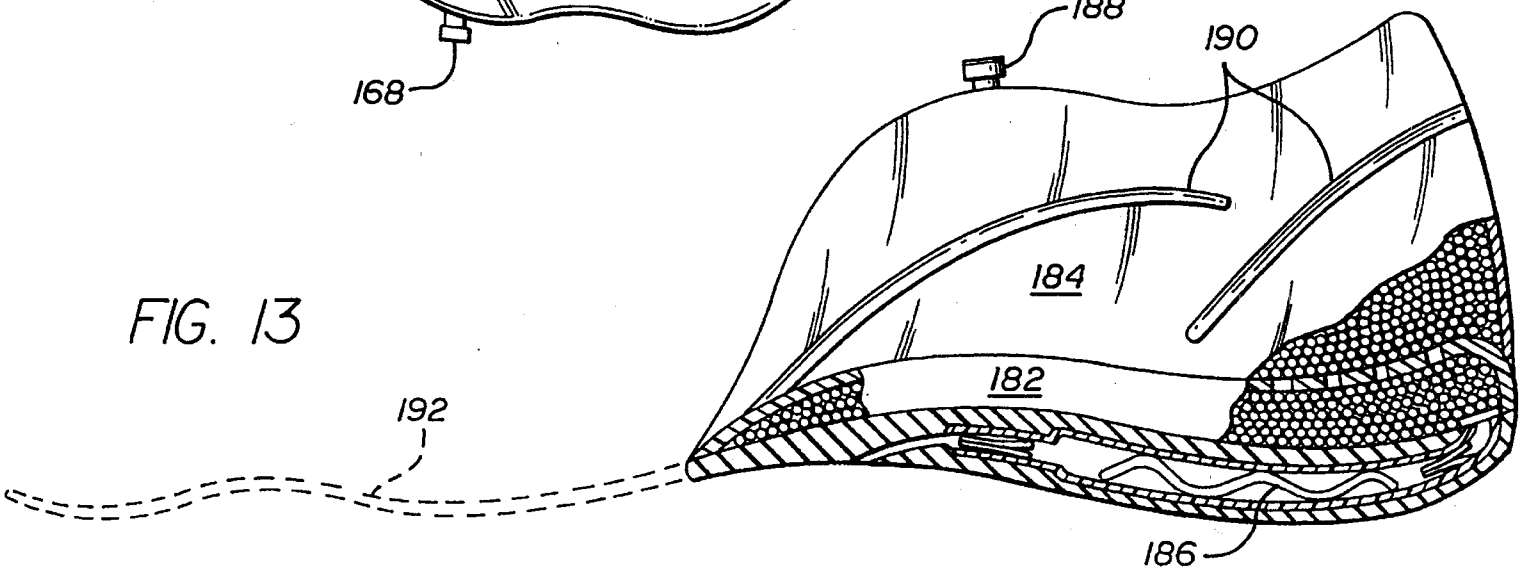
FIG. 13 is a partial cross-sectional view of an insert in which the plastic bladders are formed into intercoupled compartments for retaining the particulate material in desired zones.

FIG. 13 shows an alternative embodiment in which the conformable bladder 182 is confined to the heel and instep area, while including a conformable lining 184 extending around the rear of the foot. The pump 186, the pressure relief valve 188 and the heat sealing separation lines 180 provide the functions as described hereinabove in connection with other figures of the drawings. The dashed lines 192 indicate that the liner may extend under the forward portion of the foot, if desired.

Figure 14:
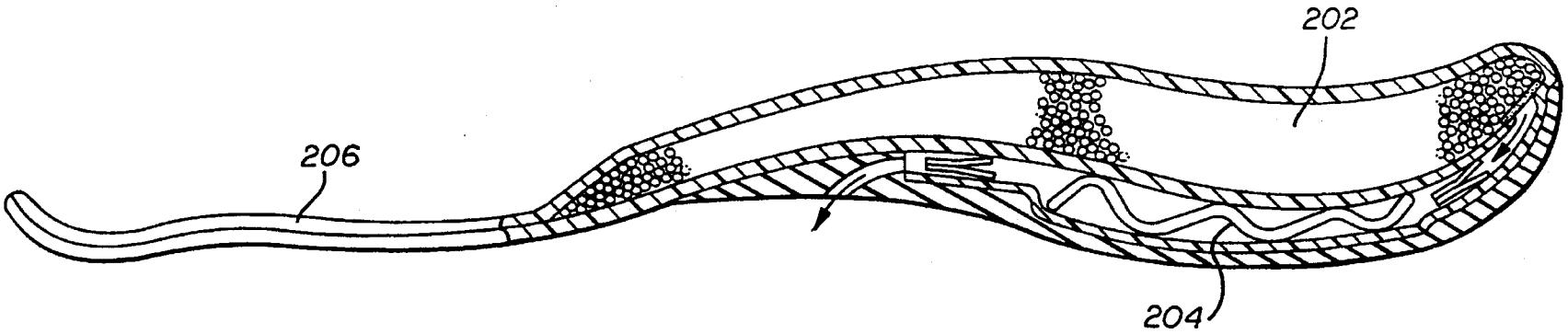
FIGS. 14 and 15 show partial and full conforming sole inserts, respectively, illustrating principles of the invention.
Figure 15:
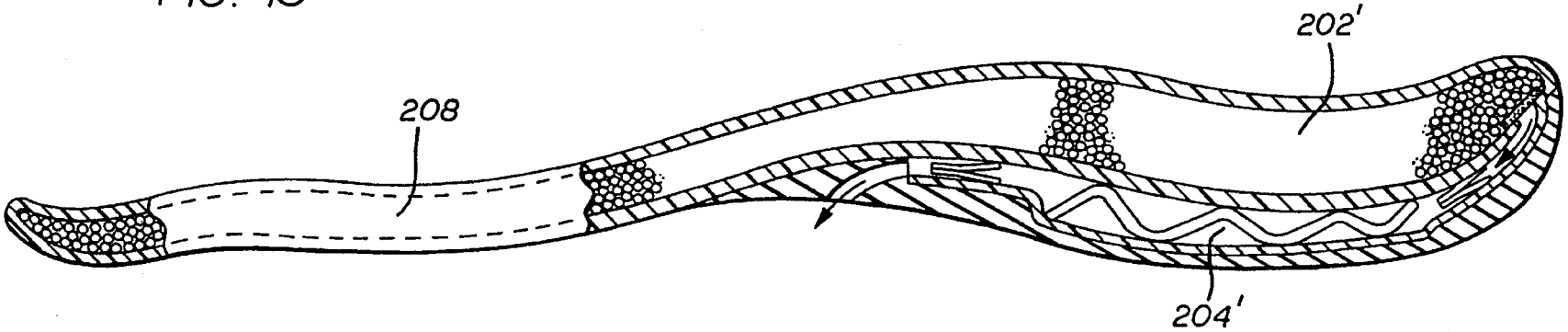

FIGS. 14 and 15 show simplified inserts involving only the sole. More specifically, the showing of FIG. 14 includes the conformable sole 202, the vacuum pump 204 and valves and conduits as described previously. A non-evacuated portion 206 of the insert may be provided if desired.

The showing of FIG. 15 is similar to that of FIG. 14 with the conformable sole area 202' and the vacuum pump 204' conforming generally to the mode of operation described hereinabove with regard to their operation. FIG. 15 differs from FIG. 14 in the extension of the conformable sole portion 208 under the front portion of the user's foot.

FIG. 16 shows an athletic shoe 302 with a vacuum formable bladder 304 in the sole, and a vacuum pump 306 mounted on the tongue 308 of the shoe. The vacuum pump 306 is coupled to the bladder 304 by the flexible duct 310, embedded in the padding material of the tongue 308. One or more additional vacuum formable bladders, indicated diagrammatically in FIG. 16 by the reference numeral 312, may be provided, with these additional bladders being coupled by ducts either directly to the vacuum pump 306 or to the bladder 304 in the sole. The vacuum formable bladders contain any of the materials discussed elsewhere in the present specification.

FIG. 17 indicates diagrammatically that vacuum formable bladders 322 and 324, intercoupled by the duct 326 in the shoe sole 328, may be located in the high impact or high stress areas under the heel and ball of the user's foot. Particularly for diabetic users or patients, it is important to provide localized stress relief to avoid ulcers or other similar problems which may plague persons suffering from diabetes. It is noted in passing that for some medical conditions, a relatively stiff or rigid outer sole is desirable with a flexible inner sole and/or upper portion of the shoe; and vacuum formable bladders of the type disclosed in this specification are particularly adapted to such shoes.

Figure 18:
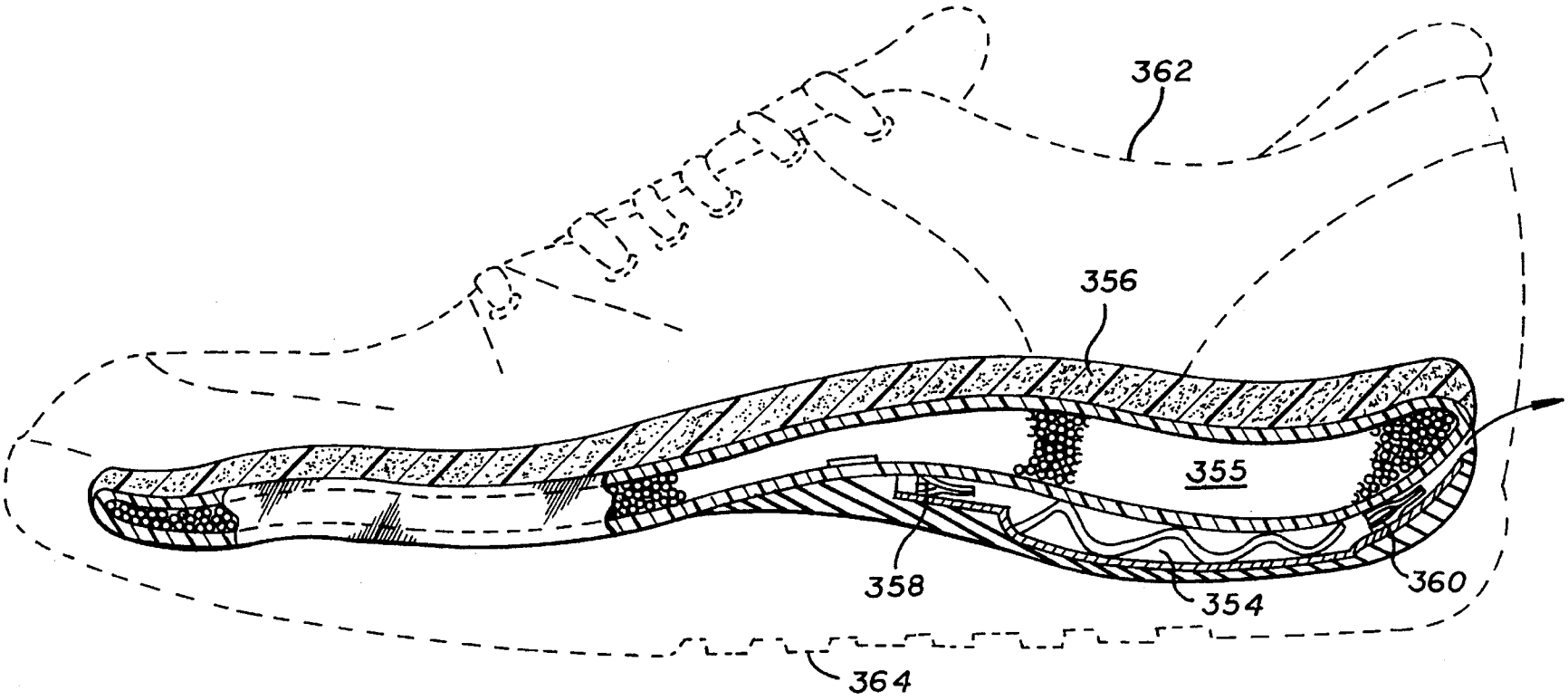
FIG. 18 shows an alternative vacuum formable shoe sole configuration.

FIG. 18 is a showing of a vacuum formable bladder with the vacuum pump 354 located in the heel area, below the bladder 355. In addition, a relatively thin cushioning layer 356 may be provided over the bladder 355. The vacuum pump 354 is coupled to withdraw air from bladder 352 by the "flapper" type flat plastic valve 358, and to exhaust air from the assembly through a similar valve 360.

The assembly as shown in FIG. 18 may be an insert to be added to an existing shoe, or may be built into a shoe. The dashed lines 362 indicate shoe upper, and the dashed lines 364 indicate a thicker outer sole, when the FIG. 18 assembly is formed as an integral part of a shoe. With the pump 354 of FIG. 18 being below the bladder 355 and the layer 356, it may be formed of spring metal without being noticeable by the user.

FIG. 19 shows graphically the reduction in height of a series of samples of open cell foam, as the pressure is reduced. In conducting these tests, a series of available samples of foams were enclosed in a bladder and the pressure within the bladder was reduced. Atmospheric pressure is about 30 inches of mercury (Hg) so the tests of FIG. 19 reduce the pressure by about ⅓ of atmospheric pressure to about ⅔ of atmospheric pressure. It is also known that atmospheric pressure is about 14.7 pounds per square inch, so a reduction in pressure of 10 inches of mercury would correspond to a reduction of about 5 pounds per square inch which is effectively applied to the foam.

The stiffness of foam may be measured by the I.F.D. or the Indentation Force Deflection, which may be measured by the amount of force in pounds required on an 8 inch diameter plate to reduce the thickness of a 4 inch thick sample of foam by 25%, or to a 3 inch thickness. The samples shown in FIG. 19 are estimated to range from an IFD of about 100 for the stiffest (High IFD) sample to about 30 for the softer or least stiff sample. Following depression, some samples of foam recover slowly, and others recover rapidly. The two "Medium" samples included one rapid recovery sample and one slow recovery sample.

For applications where the open cell foam is to be included in a footgear sole, a relatively high IFD in the order of 50 or 100 or more is desired, while for footwear upper padding, a relatively low IFD, in the order of 10 to 50 is preferred. It is also noted in passing that in the plastic foam industry, stiffness may be measured in accordance with other criteria and designations, but these may be converted to comparable IFD figures.

FIGS. 20 and 21 are cut away schematic showings of a bladder containing particular material which is mounted on a square mesh or grid of filaments, to prevent migration of the particular material. The particular material may, for example, be medium density polyethylene, and may have irregular shapes or may be spherical as shown. The flexible connecting filaments may be of any desired material, and successful samples have been employed using monofilament plastic fishing line.

While FIGS. 20 and 21 appear to show a single layer of particulates on a grid, in actuality several or a substantial number of layers would be provided to give appropriate cushioning and conformation properties. It may be noted that FIG. 20 shows a single bladder 402 with the matrix 404 of particulate material mounted on a grid of filaments. On the other hand, FIG. 21 shows a sole 406 which may have a molded outer portion 408 with a series of pockets 410 containing the grids of particulate material and filaments. The arrangements of FIGS. 20 and 21 would of course be included in complete assemblies susceptible of partial evacuation of the type shown in other figures of the drawings.

Figure 22:
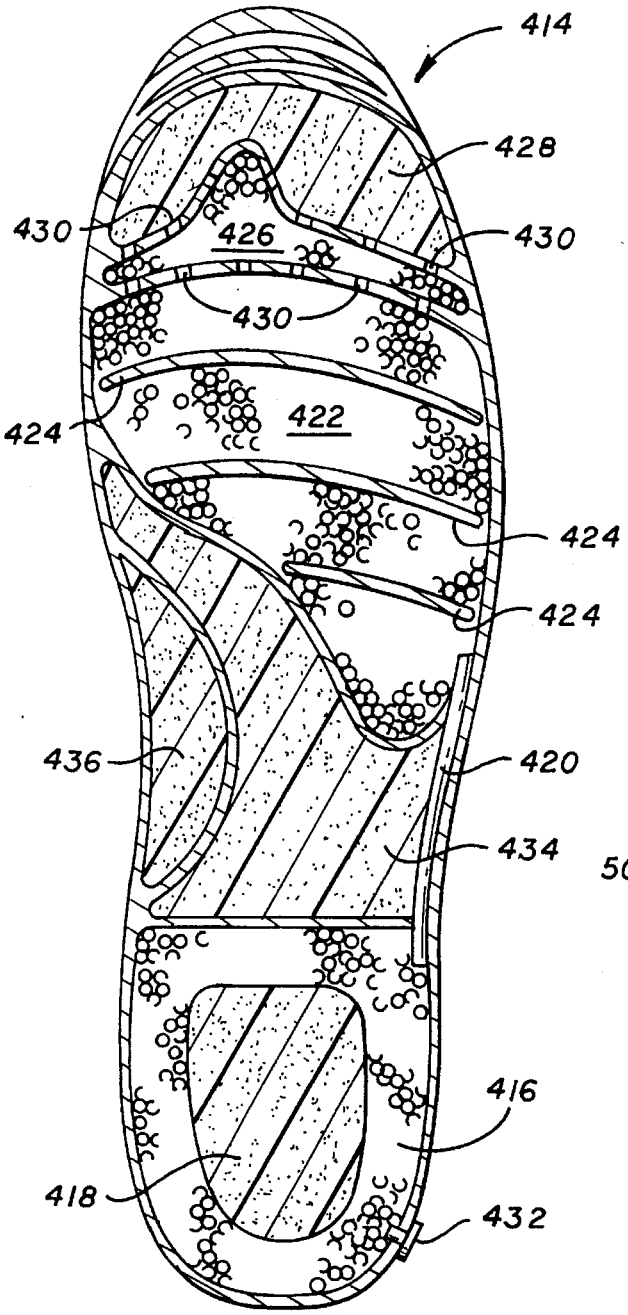
FIG. 22 shows a shoe sole configuration using both particulate material and foam, some with reduced pressure conformation within a bladder configuration and some outside of the bladders.

FIG. 22 shows a sole configuration 414 including a combination of foot supporting structures. More specifically, the sole configuration of FIG. 22 may include a rear bladder 416 which extends peripherally around the heel area and encloses a central closed cell foam zone 418 providing cushioning apart from the conformable bladder 416. A plastic tube 420 couples the particulate filled bladder 416 with a conformable bladder 422 which underlies the ball of the foot. The bladder 422 is provided with a number of transverse welds 424 which extend partially across the bladder 422, to prevent undue migration of the enclosed particulate material. In addition, the toe box zone includes the area 426 which may be filled with particulate material, and the open cell foam filled zone 428, with both of these zones being coupled to the reduced pressure areas 422 and 416 by the openings 430. The valve 432 is provided which has two settings, one in which it is a one-way only valve permitting the exhausting of air from the bladders 416 and 422, when foot pressure is applied to the sole. In its other adjustment position, the valve 432 permits the ingress of air so that the partial vacuum is restored to a normal atmospheric pressure.

The section 434 in the instep area may be outside of the conformable bladder areas and may be formed of relatively low stiffness open or closed cell foam. Similarly, the zone 436 in the arch area may be provided with relatively low stiffness resilient foam material.

Figure 23:
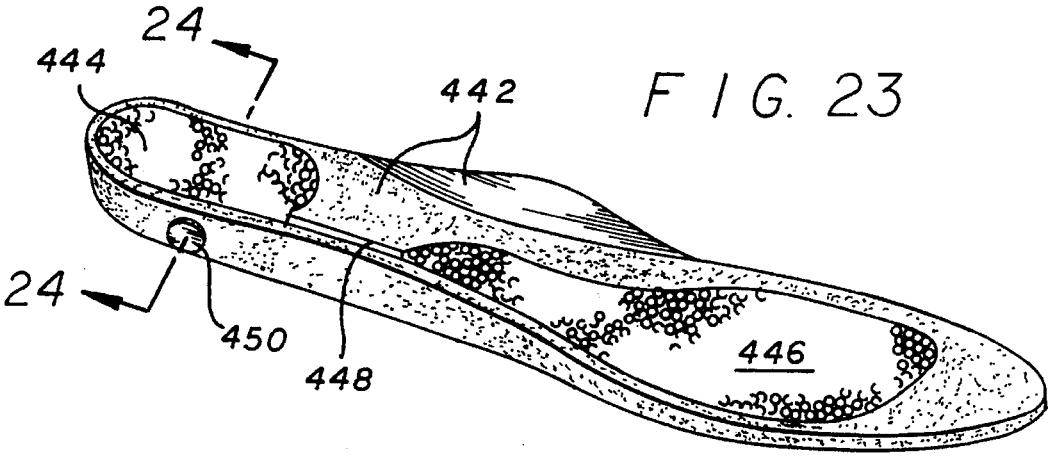
FIGS. 23 and 24 illustrate a sole configuration wherein particulate material is confined within a foam enclosure, located in turn within a plastic film bladder.

Referring now to FIG. 23, it is a partially cut-away sole configuration formed preferably of an open cell or closed cell foam body portion 442, with a heel zone 444 and a front or forefoot zone 446, interconnected by the tube or air coupling passageway 448. The valve 450 may be of the two state type previously discussed, in which when it is turned in one direction is a one-way exhaust valve, and when turned in the other direction, permits the reentry of air.

Figure 24:
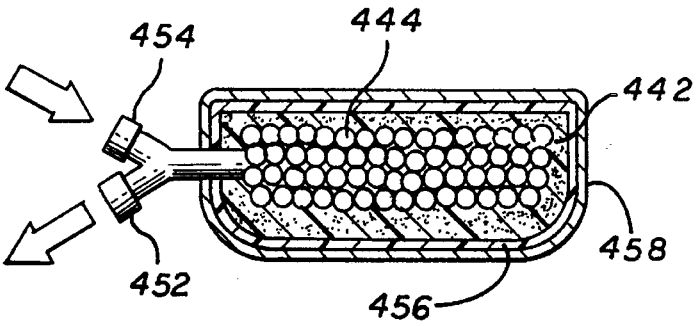

Alternatively, as shown in FIG. 24, a cross sectional view taken through line 24—24 of FIG. 23, two valves may be provided with one valve 452 being shown schematically, constituting an outlet valve when evacuating air, and the other valve 454, also shown schematically, being a release valve, when it is selectively opened. The one-way outlet valve may be a flapper type valve as shown in the early figures of the present drawing, and the release valve may be of any standard opened/closed air valve of a compact type. Also shown in FIG. 24 is the central portion of the heel zone 444, containing particulate material of any of various types described elsewhere in the present specification. Surrounding the zone 444 is the foam material 442, with an outer urethane bladder 456 laminated to an outer brushed nylon layer 458, if desired. In using a closed cell foam for the body portion 442, the urethane and/or brushed nylon may extend only over the upper surface thereof, and being bonded thereto to close the front and rear chambers 444 and 446. The sole configuration of FIGS. 23 and 24 may form an integral part of a flexible shoe of the type disclosed hereinabove, or of an insert, or of a sandal as disclosed hereinbelow.

Figure 25A:
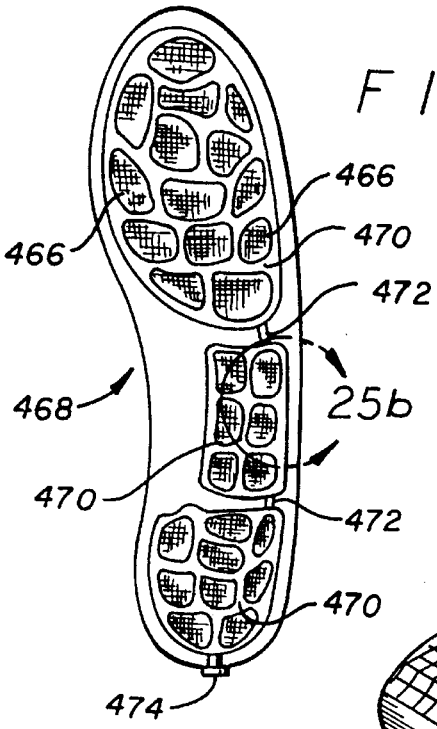
FIGS. 25A, 25B and 25C illustrate interconnected bladders wherein migration of particulate material is avoided by the use of pockets of mesh-like material.
Figure 25B:
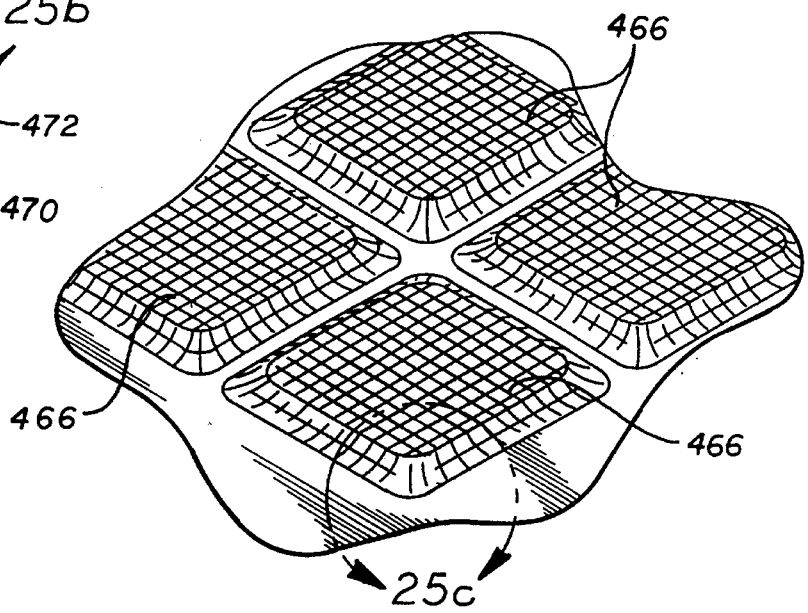
Figure 25C:
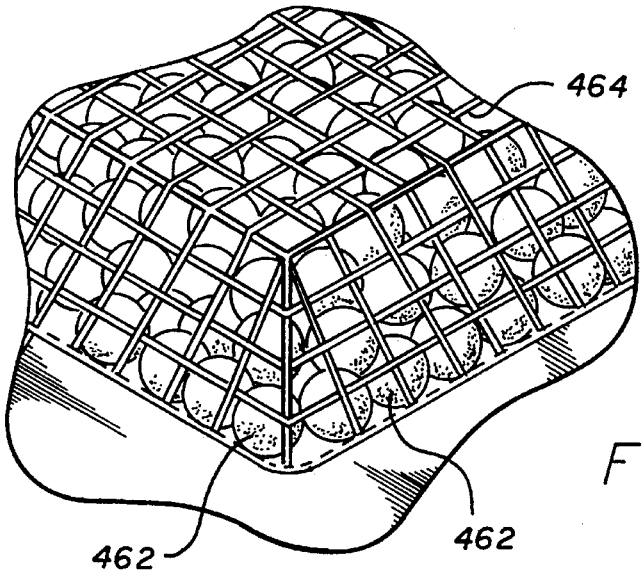

FIGS. 25A, 25B and 25C illustrate an alternative sole configuration in which particulate material 462 is restrained against migration by woven or mesh like material 464 forming pockets 466 for inclusion in a sole construction 468. The sole 468 may include a plurality of vacuum conformable zones 470 interconnected by tubes 472 and having a valve 474 to permit partial evacuation when pressure is applied to the sole construction and re-entry of air when pressure equalization is desired.

Figure 26:
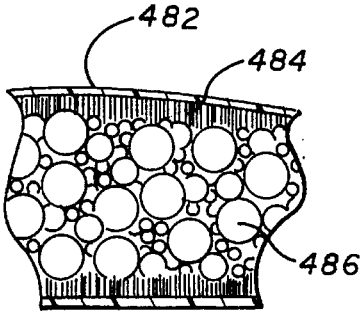
FIG. 26 is a cross-sectional view of a bladder containing particulate material, within a lined bladder.

FIG. 26 is a cross sectional view of a bladder which may be employed in the implementation of the conformable bladders in any of the arrangements shown in the present specification. In FIG. 26 there is shown an outer laminate including a layer of urethane 482 laminated to a brushed nylon or mesh lining 484, with particulate material 486 of various sizes within the bladder. The use of the brushed nylon or the mesh material laminated to the urethane layer forming the outer wall of the bladder serves to inhibit migration of the particulate material within the bladder.

Figure 27:
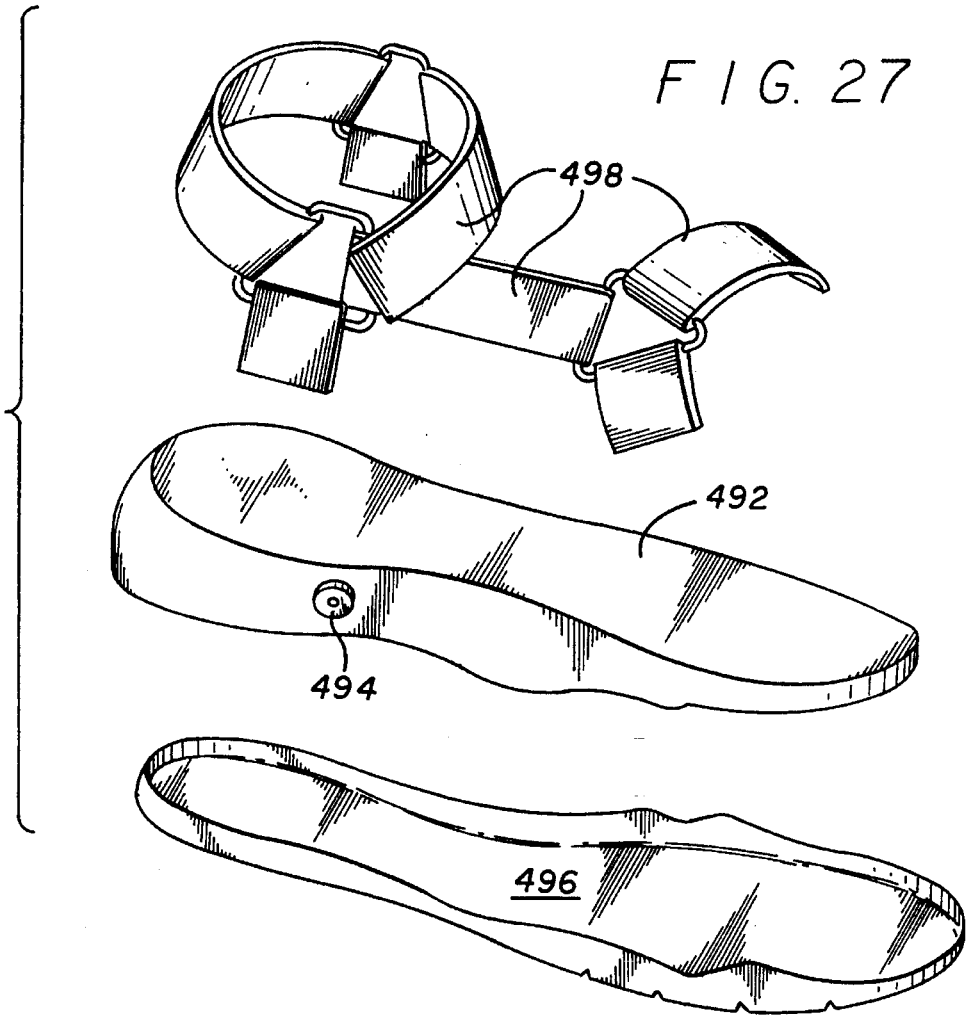
FIG. 27 is an exploded view of a sandal, showing a simplified embodiment illustrating the principles of the invention.

FIG. 27 is an exploded view of a sandal showing a central vacuum conformable sole member or bladder 492 provided with a valve 494 for selectively permitting the exhaustion of air when the sole is compressed, or releasing air into the sole when it is desired that the conformed state be changed and atmospheric pressure again be permitted to enter the sole chambers. A hard rubber outer sole 496 may be provided for securing below the conformable sole member 492, for increased wear purposes. Appropriate straps 498 with suitable VELCRO hook and loop type attaching arrangements may also be provided to complete the sandal configuration.

Figure 28:
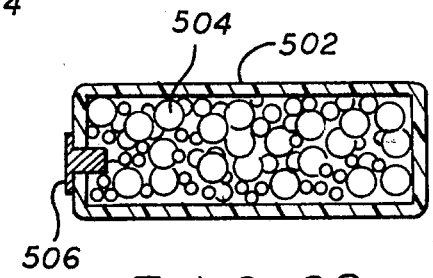
FIGS. 28 and 29 are cross sectional views showing a vacuum conformable sole, in the uncompressed, and in the compressed and conformed states, respectively.
Figure 29:
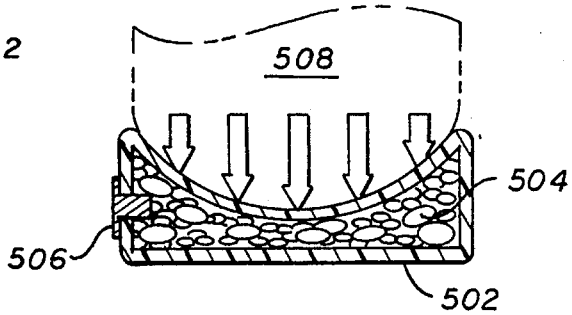

FIGS. 28 and 29 are cross sectional views each showing an outer bladder 502 containing inner vacuum conformable material 504 and a valve 506. With the sole being uncompressed, and with the inner chamber being at atmospheric pressure, the valve may be set to its "exhaust-only" state. With this setting of the valve, when a foot 508 applies force to the bladder, it is compressed as indicated in FIG. 29, and retains its conformed shape. Subsequently, the valve 506 may be shifted to its released state, and the bladder will return to the configuration shown in FIG. 28.

Figure 30A:
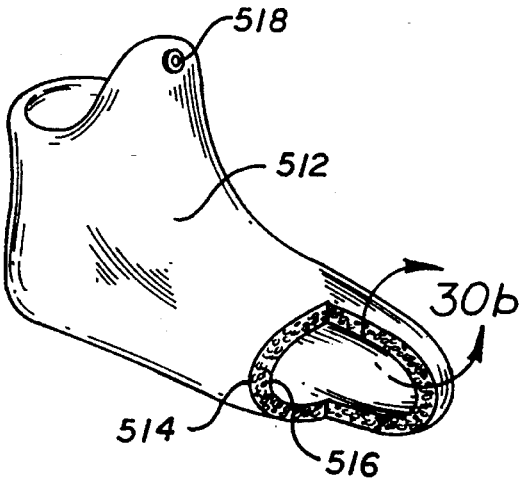
FIG. 30 is a vacuum conformable "sock" for use with an oversize shoe.
Figure 30B:
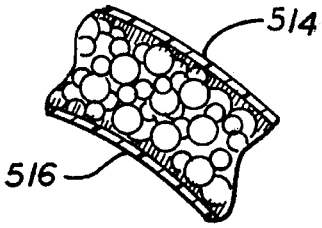

FIG. 30 shows a vacuum conformable sock 512, having inner and outer layers 514 and 516 formed of a laminated brushed nylon and urethane laminate, and enclosing vacuum conformable material such as open cell foam, or particulate material. The inlet/exhaust valve 518 has two states, the exhaust only state wherein pressure by the foot will cause permanent conformation of the sock, and the alternative release position wherein the sock bladder returns to its normal configuration. A vacuum conformable sock of the type shown in FIG. 30 will normally be employed with a shoe which is somewhat oversized as compared with the normal size shoe that a user would wear, or which is specially designed to accommodate the sock.

Figure 31:
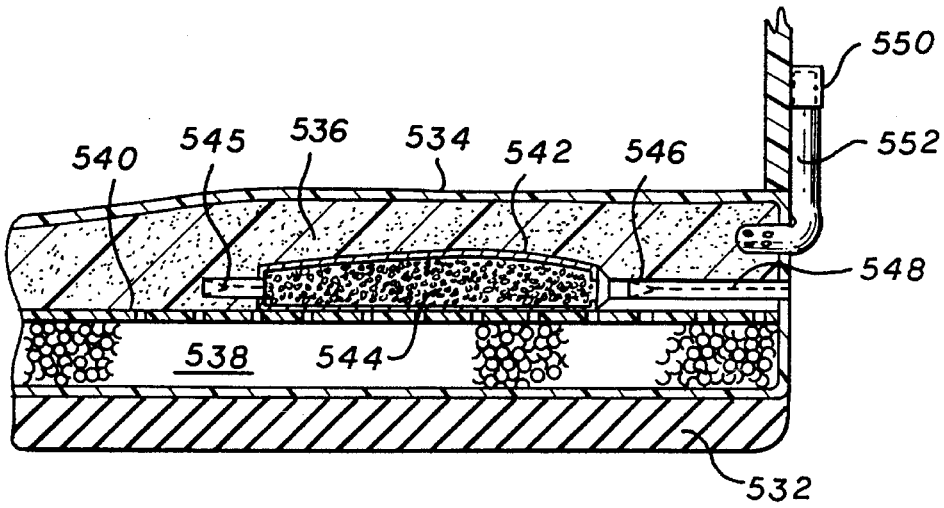
FIG. 31 shows a sole construction including an open cell foam pump and both a particulate material layer and an open cell foam layer, with these layers being actuable to a vacuum conformed state together.

FIG. 31 is patterned after FIG. 3 and may be employed as disclosed hereinabove in connection with FIG. 3. The sole construction as shown in FIG. 31 includes the outer sole 532 and a bladder 534 which encloses both the open cell foam layer 536, and the particulate material layer 538. The two layers 536 and 538 are separated by an apertured membrane or plastic film layer 540. The pump 542 includes a central resilient section 544 of relatively stiff open cell foam material, which may be compressed when the user puts weight on his or her heel, and expands when pressure is withdrawn, and includes one way valves 545 and 546. The valve 545 serves to draw air from the bladder 534, and the valve 546 serves to exhaust air through the tube 548 to a space outside of the shoe. The release valve 550 is coupled to the bladder 534 by the tube 552. If desired, the pump 542 and the valve 545 may be eliminated, so that pressure on the bladder 534 by the foot, will provide substantially single cycle pump action exhausting air through the valve 546. Of course, continued use of the shoes and continued cyclical pressuring of the sole while the user is walking or running, may further exhaust additional air through the flapper one-way exit valve 546.

For completeness, several additional points should be noted. First, a number of different types of materials may be employed as the particulate material, in addition to the materials noted hereinabove. This particulate material could be formed of ground up beans, ground up cork and ground up rubber or santoprene rubber pellets. The foams, both open cell and close cell, could be urethane foams, rubber foams or various other expanded plastic foams.

One suitable source for foams includes the following company:

American Excelsior Company 3127 S. 31st Street
Sheboygan, Wis. 53081 (414) 458-4333

Suitable valves for use for the functions described herein may be obtained from the following companies:

Vernay Laboratories, Inc. P.O. Box 310 Yellow Springs, Ohio 45387-0310 (513) 767-7261

Halkey-Roberts Corporation 11600 Ninth Street North St. Petersburg, Fla. 33716 (813) 577-1300

One company which prepares brushed nylon/urethane laminates is listed below:

Mann Industries 225 Arlington Street P.O. Box 689 Framingham, Mass. 01701 (508) 879-6366

One source of thermoplastic elastomers which may be employed in various embodiments disclosed herein is the following company:

Shell Chemical Company 4255 Naperville Road, Suite 375 Lisle, Ill. 60532-3660 (708) 955-6500

The bladders may be formed by a reaction-injection molding process in which two different chemicals are supplied to a mold, and these two chemicals react to form an open cell polyurethane foam, with a sealed peripheral bladder structure formed in situ. This process could particularly advantageously be employed to produce the sole member 492 of the sandal of FIG. 27. However, the same process could also be used to manufacture vacuum conformable sole or upper lining members of other embodiments disclosed in the drawings of the present specification. One company which supplies this type of molded product is:

Urethane Technologies, Inc. 1202 E. Wakeham Avenue Santa Ana, Calif. 92705-4145 (714) 973-0800

In conclusion, it is to be understood that the foregoing detailed description and the accompanying drawings merely relate to preferred embodiments of the invention. Various modifications and alternative constructions may be employed without departing from the spirit and scope of the invention. Thus, by way of example, and not of limitation, instead of the metal spring plates employed to expand the vacuum pump structure, a suitable resilient open cell foam material could be employed. The bladder 18 and the conduits 24, 26, as well as the housings for the pump and the valves may be made of polyurethane or other high strength, flexible, plastic materials. The principles of the invention are applicable to various athletic shoes, walking shoes, boots and dress shoes, and the term "shoe" as employed, herein encompasses all of these types of footwear. The inner sole, including the sealed bladder, may be made separate from the shoe, and inserted into the shoe, and may include the foot actuated vacuum pump; or a separate vacuum pump may be provided. It is further noted that in some cases, the principles of the invention could be applicable to the tongue and the sidewalls of footwear, without the presence of a conformable sole. In addition, the pump employed for evacuation of the bladders could be mounted on the shoe in other locations than in the sole, for example, for manual operation on the tongue of the shoe, or by a separate pump. It is also noted that the vacuum formable bladder could be formed with one wall of the bladder being a fairly thick lower or outer impervious, perhaps rubber, sole. Concerning evacuation of all of the bladders disclosed herein, it is noted that partial evacuation for all of them may be accomplished either by foot pressure or by a supplemental pump, either in the sole, or on the tongue of the shoe, or external to the shoe. Accordingly, the present invention is not limited to the specific preferred embodiments shown in the drawings and described hereinabove.

What is claimed is:

1. A conformable shoe assembly including a vacuum forming configuration, comprising:

a shoe body;

said shoe body including a sole including a sealed bladder containing particulate material of substantially interlocking properties under vacuum conditions said bladder constituting means for inherently retaining its shape and remaining conformed to its initial state under partial vacuum conditions;

said bladder being resilient under partial vacuum conditions and providing shaped support for the foot;

a vacuum pump for withdrawing air from said sealed bladder; and said pump being mounted onto said shoe assembly;

means for actuating said pump to withdraw air from said bladder;

said shoe assembly including means for permitting removal of the shoe and remounting on a foot while the bladder is partially evacuated with the bladder retaining its conformed configuration; and said bladder having a reduced thickness and configuration when it is partially evacuated as compared with its configuration at atmospheric pressure;

whereby said sole inherently conforms to the shape of the user's foot and retains this configuration until the partial vacuum in said bladder is released.

2. A comformable shoe assembly as defined in claim 1 wherein said particulate material is formed of resilient non-shattering material.

3. A conformable shoe assemble as defined in claim 1 wherein said sealed bladder is an integral part of said shoe.

4. A conformable shoe assembly as defined in claim 1 wherein said bladder is included in a shoe sole insert assembly which is wholly separate from and not an integral part of any shoe, and is removably replaceable in any shoe, whereby it is adaptable to be used in a plurality of shoes.

5. A conformable shoe assembly as defined in claim 1 wherein said assembly includes a flapper type one way valve, the components of said valve being of flat plastic material coupled to said bladder.

6. Conformable footgear as defined in claim 1 wherein said sole forms part of a sock type assembly which substantially encloses the foot of the user.

7. A conformable shoe assembly including a vacuum formed configuration, comprising:

a shoe body;

said shoe body including an inner sealed bladder, said inner sealed bladder including means for retaining its shape under partial vacuum conditions and said means including resilient particulate material of substantially interlocking properties under vacuum conditions;

vacuum pump means for withdrawing air from said sealed bladder;

said vacuum pump being mounted on said shoe;

said inner sealed bladder constituting means for providing a resilient support for the user's anatomy in the foot and ankle area resulting from the resilient particulate material within the sealed bladder;

said shoe assembly including means for permitting removal of the shoe and remounting on a foot while the bladder is partially evacuated with the bladder retaining its conformed configuration; and said bladder having a reduced thickness and configuration when it is partially evacuated as compared with its configuration when not evacuated;

whereby said inner sealed bladder provides shaped support for the user's foot and adjacent anatomy when air is withdrawn from said bladder.

8. A conformable shoe assemble as defined in claim 7 wherein said sealed bladder is an integral part of said shoe.

9. A conformable shoe assembly as defined in claim 7 wherein bladder is included in a shoe sole insert assembly which is wholly separate from and not an integral part of any shoe, and is removably replaceable in any shoe, whereby it is adaptable to be used in a plurality of shoes.

10. A conformable shoe assembly including a vacuum formed configuration, comprising:

a shoe body;

said shoe body including an inner sealed bladder, said inner sealed bladder including means for retaining its shape under partial vacuum conditions and said means including particulate material of substantially interlocking properties under vacuum conditions;

vacuum pump means for withdrawing air from said sealed bladder;

said vacuum pump being mounted on said shoe;

said inner sealed bladder constituting means for providing shaped support for the user's anatomy resulting from the particulate material within the sealed bladder;

said shoe assembly including means for permitting removal of the shoe and remounting on a foot while the bladder is partially evacuated with the bladder retaining its conformed configuration; and said bladder having a reduced thickness and configuration when it is partially evacuated as compared with its configuration when not evacuated;

whereby said inner sealed bladder provides shaped support for the user's anatomy when air is withdrawn from said bladder.

11. A conformable shoe assembly as defined in claim 10 wherein said particulate material is formed of resilient non-shattering material.

12. A conformable shoe assemble as defined in claim 10 wherein said sealed bladder is an integral part of said shoe.

13. A conformable shoe assembly as defined in claim 10 wherein bladder is included in a shoe sole insert assembly which is wholly separate from and not an integral part of any shoe, and is removably replaceable in any shoe, whereby it is adaptable to be used in a plurality of shoes.

14. A vacuum formed conformable shoe insert assembly comprising:

an inner sole formed of a sealed bladder, and inner sole including means for inherently retaining its shape and remaining conformed to its initial shape at the time of evacuation, under partial vacuum conditions;

a vacuum pump for withdrawing air from said bladder;

said shoe sole insert assembly being not an integral part of any shoe, and being removably replaceable in any shoe, while the bladder is partially evacuated with the bladder retaining its conformed configuration, whereby it is adapted to be used in a plurality of shoes; and said bladder having a reduced thickness and configuration when it is partially evacuated as compared with its configuration when not evacuated.

15. A conformable shoe assembly as defined in claim 14 wherein said bladder includes particulate material of substantially interlocking shapes.

16. A conformable shoe assembly as defined in claim 14 wherein said vacuum pump is an integral part of said insert assembly.

17. A conformable shoe assembly as defined in claim 14 wherein said bladder includes resilient, compressible non-shattering particulate material.

18. A conformable shoe assembly as defined in claim 14 wherein said assembly includes a flapper type one way valve, the components of said valve being of flat plastic material coupled to said bladder.

19. A vacuum formed conformable shoe insert assembly comprising:

an inner shoe insert formed of a sealed bladder, said bladder including means for inherently retaining its shape and remaining conformed to its initial shape at the time of evacuation, under partial vacuum conditions;

vacuum pump means for withdrawing air from said bladder;

said shoe insert assembly being not an integral part of any shoe, and being removably replaceable in any shoe, while the bladder is partially evacuated with the bladder retaining its conformed configuration, whereby it is adapted to be used in a plurality of shoes; and said bladder having a reduced thickness and configuration when it is partially evacuated as compared with its configuration at atmospheric pressure.

20. A conformable shoe assembly including a vacuum forming configuration, comprising:

a shoe body;

said shoe body including a sole including a sealed bladder containing particulate material of substantially interlocking shapes, said bladder constituting means for inherently retaining its shape and remaining conformed to its initial state under partial vacuum conditions;

said bladder being resilient under partial vacuum conditions and providing shaped support for the foot;

a valve coupled to said sealed bladder permitting one-way flow of air out of said bladder when said bladder is compressed;

said shoe assembly including means for compressing said bladder to provide a partially evacuated state upon compression by the foot of a user;

said shoe assembly including means for permitting removal of the shoe and remounting on a foot while the bladder is partially evacuated with the bladder retaining its conformed configuration; and said bladder having a reduced thickness and configuration when it is partially evacuated as compared with its configuration when not evacuated;

whereby said sole inherently conforms to the shape of the user's foot and retains this configuration until the partial vacuum in said bladder is released.

21. Conformable footgear including a vacuum forming configuration, comprising:

a sole including a sealed bladder containing yieldable material constituting means for (1) inherently retaining its shape and remaining conformed to its modified configuration under partial vacuum conditions; and (2) under atmospheric pressure when not evacuated, repeatedly conforming to the shape of the foot of users applied to said sole;

said bladder being resilient under partial vacuum conditions and providing shaped support for the foot;

a valve coupled to said sealed bladder permitting one-way flow of air out of said bladder when said sole is compressed;

said bladder being compressible to provide a partially evacuated state upon compression by the foot of a user;

said bladder having a reduced thickness and configuration when it is partially evacuated as compared with its configuration when not evacuated;

said footgear including a foot engaging assembly for holding said sole in position underlying the foot of a user; and said footgear including means for permitting removal of the footgear and remounting on a foot while the bladder is partially evacuated with the bladder retaining its conformed configuration;

whereby said bladder inherently conforms to the shape of the user's foot and retains this configuration until the partial vacuum in said bladder is released.

22. Conformable footgear as defined in claim 21 wherein said bladder contains resilient particulate material.

23. Conformable footgear as defined in claim 22 wherein said bladder contains particulate material and wherein means are provided to inhibit migration of said particulate material.

24. Conformable footgear as defined in claim 21 wherein said bladder contains resilient open cell foam.

25. Conformable footgear as defined in claim 21 wherein said footgear is an open sandal, and includes straps for securing said sole to the foot of a user.

26. Conformable footwear as defined in claim 21 including a pump for repeated actuation to evacuate said bladder.

27. Conformable footgear including a vacuum forming configuration, comprising:

a sealed bladder containing yieldable material constituting means for inherently retaining its shape and remaining conformed to its modified configuration under partial vacuum conditions;

said bladder being resilient under partial vacuum conditions and providing shaped support for the foot;

a valve coupled to said sealed bladder permitting one-way flow of air out of said bladder when said bladder is compressed;

said foot gear including means for compressing said bladder to provide a partially evacuated state upon compression by engagement with the foot of a user;

said bladder having a reduced thickness and configuration when it is partially evacuated as compared with its configuration when not evacuated;

said footgear including a foot engaging assembly for holding said bladder in position supporting the foot of a user; and said footgear including means for permitting removal of the footgear and remounting on a foot while the bladder is partially evacuated with the bladder retaining its conformed configuration;

whereby said bladder inherently conforms to the shape of the user's foot and retains this configuration until the partial vacuum in said bladder is released.

28. Conformable footgear as defined in claim 27 wherein said bladder contains interlocking particulate material.

29. Conformable footgear as defined in claim 27 wherein said bladder contains resilient open cell foam.

30. Conformable footgear as defined in claim 27 wherein said bladder contains particulate material and wherein means are provided to inhibit migration of said particulate material.

31. Conformable footgear as defined in claim 27 wherein said footgear includes both interlocking particulate material and resilient foam material.

32. A conformable shoe assembly including a vacuum formed configuration, comprising:

a shoe body;

said shoe body an inner sealed bladder containing yieldable material constituting means for inherently retaining its shape and remaining conformed to its modified configuration under partial vacuum conditions;

vacuum pump means for withdrawing air from sealed bladder;

said inner sealed bladder constituting shaped support for the users anatomy in the foot area resulting from the yieldable material within the sealed bladder;

said shoe assembly including means for permitting removal of the shoe and remounting on a foot while the bladder is partially evacuated with the bladder retaining its conformed configuration; and said bladder having a reduced thickness and configuration when it is partially evacuated as compared with its configuration when not evacuated;

whereby said inner sealed bladder provides shaped support for the user's foot and adjacent anatomy when air is withdrawn from said bladder.

33. A conformable shoe assembly including a vacuum forming configuration<comprising:

a shoe body;

said shoe body including a sole including a sealed bladder containing particulate material of substantially interlocking properties under vacuum conditions, said bladder constituting means for inherently retaining its shape and remaining conformed to its initial state under partial vacuum conditions;

said bladder being resilient under partial vacuum conditions and providing shaped support for the foot;

a vacuum pump for withdrawing air from said sealed bladder;

said pump being mounted in the sole of said shoe;

means for actuating said pump to withdraw air from said bladder;

said shoe assembly including means for permitting removal of the shoe and remounting on a foot while the bladder is partially evacuated with the bladder retaining its conformed configuration; and said bladder having a reduced thickness and configuration when it is partially evacuated as compared with its normal unevacuated configuration;

whereby said sole inherently conforms to the shape of the user's foot and retains this configuration until the partial vacuum in said lining is released.

34. A conformable shoe assembly including a vacuum formed configuration, comprising:

a shoe body;

said shoe body including an inner sealed bladder, said inner sealed bladder including means for retaining its shape under partial vacuum conditions and said means including particulate material of substantially interlocking properties under vacuum conditions;

vacuum pump means for withdrawing air from said sealed bladder;

said pump being mounted in the sole of said shoe;

said inner sealed bladder constituting a resilient support for the user's anatomy in the foot and ankle area resulting from the resilient compressible particulate material within the sealed bladder;

said shoe assembly including means for permitting removal of the shoe and remounting on a foot while the bladder is partially evacuated with the bladder retaining its conformed configuration; and said bladder having a reduced thickness and configuration when it is partially evacuated as compared with its normal unevacuated configuration;

whereby said inner sealed bladder provides shaped support for the user's foot and adjacent anatomy when air is withdrawn from said bladder.

35. A conformable shoe assembly including a vacuum formed configuration, comprising:

a shoe body;

said shoe body including an inner sealed bladder, said inner sealed bladder including means for retaining its shape under partial vacuum conditions and said means including particulate material of substantially interlocking properties under vacuum conditions;

vacuum pump means for withdrawing air from said sealed bladder;

said vacuum pump being mounted immediately adjacent said sealed bladder, and constituting means for evacuating said sealed bladder when the user walks, runs, or puts weight on the foot on which said shoe assembly is mounted;

said inner sealed bladder constituting shaped support for the user's anatomy in the foot and ankle area resulting from the particulate material within the sealed bladder;

said shoe assembly including means for permitting removal of the shoe and remounting on a foot while the bladder is partially evacuated with the bladder retaining its conformed configuration; and said bladder having a reduced thickness and configuration when it is partially evacuated as compared with its normal unevacuated configuration;

whereby said inner sealed bladder provides shaped support for the user's foot and adjacent anatomy when air is withdrawn from said bladder.

36. A conformable shoe assembly including a vacuum formed configuration, comprising:

a shoe body;

said shoe body including an inner sealed bladder, said inner sealed bladder including means for retaining its shape under partial vacuum conditions and said means including particulate material of substantially interlocking properties under vacuum conditions;

vacuum pump means for withdrawing air from said sealed bladder;

said pump being mounted in the sole of said shoe;

said inner sealed bladder constituting shaped support for the user's anatomy in the foot and ankle area resulting from the particulate material within the sealed bladder;

said shoe assembly including means for permitting removal of the shoe and remounting on a foot while the bladder is partially evacuated with the bladder retaining its conformed configuration; and said bladder having a reduced thickness and configuration when it is partially evacuated as compared with its normal unevacuated configuration;

whereby said inner sealed bladder provides shaped support for the user's foot and adjacent anatomy when air is withdrawn from said bladder.

* * * * *

UNITED STATES PATENT AND TRADEMARK OFFICE

CERTIFICATE OF CORRECTION

PATENT NO. : 5,617,650

DATED : April 8, 1997

INVENTOR(S) : Tracy E. Grim

It is certified that error appears in the above-indentified patent and that said Letters Patent is hereby corrected as shown below:

Claim 14, column 13, line 49, in line 1 of Claim 14 change "formed" to --forming--

Claim 19, column 14, line 11, in line 1 of Claim 19 change "formed" to --forming--.

Claim 33, column 16, line 25, in line 2 of Claim 33 delete the symbol "<" from between the word "configuration" and the word "comprising" and insert--,--.

Signed and Sealed this

Seventh Day of April, 1998

Bruce Lehman

*Attest:*

BRUCE LEHMAN

*Attesting Officer*

*Commissioner of Patents and Trademarks*